United States Patent [19]

Kojima et al.

[11] Patent Number: 4,483,313

[45] Date of Patent: Nov. 20, 1984

[54] REFLECTION TYPE HEATER

[75] Inventors: Nobuyuki Kojima; Etsuko Kawashima, both of Kamo, Japan

[73] Assignee: Toshiba Heating Appliances Co., Ltd., Kamo, Japan

[21] Appl. No.: 464,697

[22] Filed: Feb. 7, 1983

[51] Int. Cl.[3] ..... F24C 3/04

[52] U.S. Cl. ..... 126/92 R; 126/84

[58] Field of Search ..... 126/92 B, 92 R, 97, 126/86, 62, 93, 63, 86, 89, 91 R, 84, 96, 142, 85 R; 165/134 R; 239/288, 288.3, 288.5

[56] References Cited

U.S. PATENT DOCUMENTS 6233 1/1875 Phillips ..... 126/63

3,362,394 1/1968 Cole et al. ..... 126/63

FOREIGN PATENT DOCUMENTS 45-28062 11/1970 Japan .

47-25059 8/1972 Japan .

579227 7/1946 United Kingdom ..... 126/92 B

*Primary Examiner*—Samuel Scott

*Attorney, Agent, or Firm*—Oblon, Fisher, Spivak, McClelland & Maier

[57] ABSTRACT

A reflection type heater comprising a box-shaped housing having a front face, with a front opening, and a top face. A burner and a burner chimney are contained in the housing. A reflecting plate is provided behind the burner chimney to reflect radiant heat from the burner chimney toward the front face of the housing. A top plate is laid on the top face of the housing. The top plate includes a tray located in that region of the top face which is enveloped by the reflecting plate, and a roof plate located in the remaining region of the top face of the housing. A guard in the form of an endless belt with its surface vertical extends along the edge of the tray.

15 Claims, 14 Drawing Figures

REFLECTION TYPE HEATER

BACKGROUND OF THE INVENTION

This invention relates to an improved reflection type heater.

In a conventional reflection type space heater, a burner chimney is provided in the center of a box-shaped housing which is open on the front side. A reflecting plate is disposed behind the burner chimney in this heater. This reflecting plate serves to radiate and diffuse combustion heat forward from the burner chimney. High-temperature air heated by combustion in the burner chimney rises therefrom toward a top plate placed over the burner chimney. Thus, that portion of the top plate which corresponds to the front side of the reflecting plate is heated to a high temperature. If a flammable object, such as a curtain or clothing, touches or falls on the heated top plate, it might well burn and start a fire. Thus, the prior art heater is not completely safe.

SUMMARY OF THE INVENTION

An object of this invention is to provide a reflection type heater which is safer than prior heaters due to the use of a guard surrounding the high-temperature portion of a top plate to keep clothes or other combustibles from touching the high-temperature portion.

Another object of the invention is to provide a reflection type heater with a guard which will not interfere with a kettle being put on the top plate nor with a cover which allows a cartridge tank to be inserted and removed.

According to the invention, there is provided a reflection type heater which comprises combustion equipment for burning fuel, a box-shaped housing having a front face with a front opening and a top face, and containing the combustion equipment therein, a reflecting member provided behind the combustion equipment for reflecting radiant heat from the combustion equipment toward the front opening, a top plate laid on the top face of the housing and having a specific region, a cartridge tank behind the reflecting member and a guard protruding from the surface of the top plate so as to surround the specific region of the top plate.

DETAILED DESCRIPTION OF THE PREFERRED EMBODIMENTS

Figure 1:
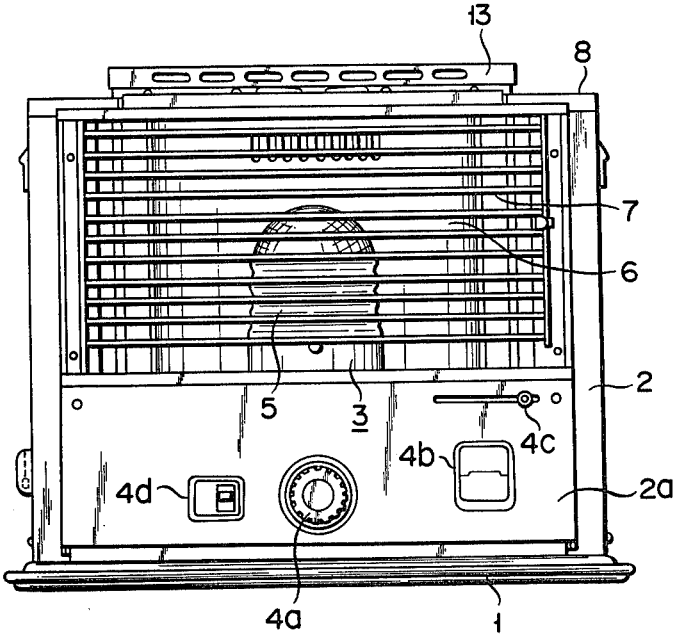
FIG. 1 is a front view of a reflection type heater according to an embodiment of this invention.
Figure 2:
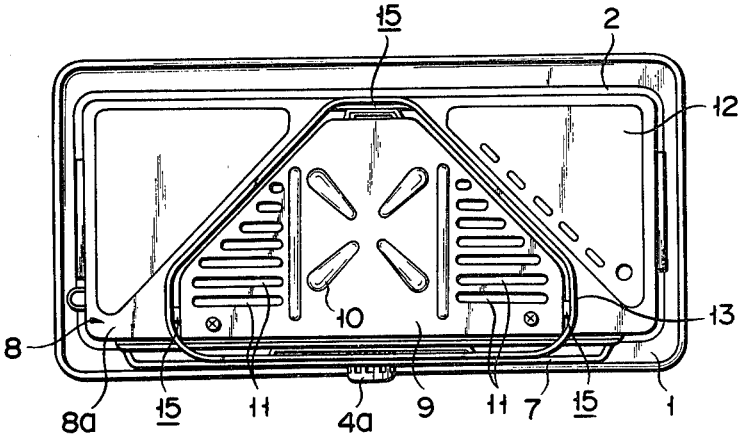
FIG. 2 is a plan view of the heater shown in FIG. 1.
Figure 3:
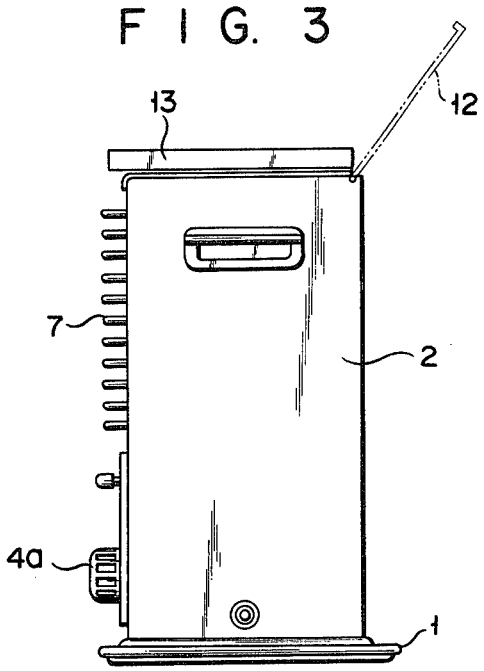
FIG. 3 is a side view of the heater shown in FIG. 1.

FIGS. 1 to 3 show a reflection type space heater according to an embodiment of this invention. A heater housing 2 is set on a tray-shaped base 1 with a flat portion. The housing 2 is in the form of a box having an opening in the upper portion of its front face. The housing 2 has a control panel 2*a* at the lower portion of the front face. A fixed tank (not shown) storing kerosene as fuel is set inside the lower portion of the housing 2 covered with the control panel 2*a*. A burner 3 is mounted on the fixed tank substantially in the center of the housing 2 as viewed from above. The burner 3 has a wick (not shown) which is impregnated with the kerosene. The wick is supported for vertical movement, having its lower end immersed in the kerosene in the fixed tank. A burner chimney 5 extends over the burner 3 to constitute combustion equipment in conjunction with the burner 3. The burner chimney 5 can be tilted relative to the burner 3. Tilting the burner chimney 5 allows the wick of the burner 3 to be ignited.

An arched reflecting plate 6 envelops the back of the burner chimney 5 at the upper portion of the housing 2. Having a mirror-like polished surface opposed to the burner chimney 5, the reflecting plate 6 reflects combustion heat of the burner chimney 5 toward the front face of the stove. An adjusting knob 4*a* is attached to the substantially central portion of the control panel 2*a* which covers the lower portions of the burner 3 and the front of the fixed tank. The adjusting knob 4*a* is used to move the wick of the burner 3 up and down for wick height adjustment. Besides the adjusting knob 4*a*, the control panel 2*a* is mounted with a fuel gauge 4*b* for indicating the amount of residual fuel in the fixed tank, a tilting lever 4*c* for tilting the burner chimney 5, and a control knob 4*d* for an extinguishing system (not shown) for stopping the combustion of the wick in an instant. A front guard 7 formed of a plurality of horizontal bars arranged vertically is removably attached to the upper portion of the front face of the housing 2 so as to cover the burner chimney 5. The front guard 7 prevents hands or other parts of the body or clothing from touching the burner chimney 5.

A top plate 8 is provided at the top face of the housing 2. The top plate 8 includes a roof plate 8*a* and an upper tray 9. The roof plate 8*a* has a substantially triangular notch portion cut along the reflecting plate 6, and is attached to the upper end portions of the side plates of the housing 2 so as to cover that portion of the housing 2 which stands behind the reflecting plate 6. At the notch portion of the roof plate 8*a*, the tray 9 having a substantially triangular shape is bolted to the roof plate 8*a* so as to be situated above the burner chimney 5. Lying over the space inside or in front of the reflecting plate 6, the tray 9 is heated by heat from the burner chimney 5. Beads 10 project a little upward from the substantially central portion of the tray 9. A plurality of holes 11 are bored through the tray 9 on both the left and right sides of the beads 10. Hot waste gas burned in the burner chimney 5 rises therefrom to the tray 9, and then disperses into the space over the housing 2 through the passage holes 11. A substantially triangular cartridge tank inlet opening (not shown) is bored through the right-hand portion (as viewed in FIG. 2) of the roof plate 8*a*. A cover 12 is attached to the roof plate 8*a* so as to be able to open and close the inlet opening. As shown in FIG. 3, the cover 12 is swung open to insert a cartridge tank (not shown) containing kerosene into the housing 2 through the inlet opening. Thereupon, the kerosene is supplied from the cartridge tank to the fixed tank through a plug at the lower end of the cartridge tank.

Figure 4:
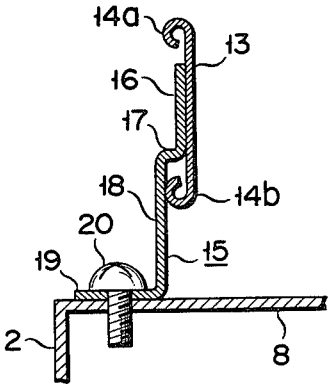
FIG. 4 is a partial sectional view illustrating the way a guard is attached to a roof plate.

A guard 13 in the form of a continuous belt is provided on the top face of the housing 2 so that its face is normal to the top face of the housing 2. The guard 13 extends along the edge of the tray 9 so as to surround the same, and is fixed to the roof plate 8*a* at the three vertex portions of the triangular tray 9 by means of fixtures 15. As shown in FIG. 4, the guard 13 is attached to each of the fixtures 15 so that the face of the guard 13 is vertical. Upper and lower end portions 14*a* and 14*b* of the guard 13 are curled inward. Each of the fixtures 15 is bent so that a bottom fitting portion 19 and a leg portion 18 thereof cross at right angles. The upper end of the leg portion 18 is connected by means of a step portion 17 to a fixing portion 16 having a vertical face. The fitting portion 19 of the fixture 15 is fixed to the roof plate 8*a* by means of a screw 20. The guard 13 is fixed to the fixing portion 16 by joining and welding together the inner surface of the guard 13 and the face of the fixing portion 16.

In the heater thus constructed, the wick of the burner 3 is ignited after operating the tilting lever 4*c*, and the wick height is adjusted by turning the adjusting knob 4*a*. Thereupon, the fuel in the fixed tank is drawn up through the wick, and combustion at the upper end of the wick is continued in the burner chimney 5. The combustion heat of the burner chimney 5 is radiated forward from the heater in a direct manner or after being reflected by the reflecting plate 6. A room is thus heated by radiant heat from the burner chimney 5. The tray 9 right over the burner chimney 5 is also heated by the radiant heat from the burner chimney 5. The hot waste gas burned by the burner 3 rises as an ascending current from the burner chimney 5 to the tray 9, and disperses into the room through the passage holes 11 of the tray 9 for circulation. The tray 9 is also heated by the ascending current of the hot waste gas. During the use of the heater, therefore, the tray 9 is heated to a very high temperature. If a combustible object, such as a curtain or clothing, falls on or hangs down over the top plate 8 of the heater during use, it will be caught by the guard 13 so as not to touch the tray 9 completely. Although the object hangs down in the center of the region surrounded by the guard 13 and the hanging portion of the combustible object may touch the central portion of the tray 9, those portions caught by the guard 13 and their adjoining portion will not touch the tray 9. Due to the passage of the hot waste gas, those portions of the tray 9 which are provided with the passage holes 11 are heated to a higher temperature than those of any other portions. Since the guard 13 is provided near the passage holes 11, however, the combustible object will never touch these high-temperature portions. Thus, the possibility of the combustible object catching on fire immediately will be significantly reduced. Surrounding the tray 9, the guard 13 will not prevent a kettle or the like from being put on the beads 10. Lying on the boundary between the front and back sides of the reflecting plate 6, moreover, the guard 13 will not prevent the swinging of the cover 12. The temperature of the tray 9 and the distribution of its hottest portions will vary with the amount of heat produced by the heater or the structural design of the heater. The guard 13 may be suitably positioned in consideration of the position of the high-temperature region. Non-contact regions between the combustible object and the tray 9 can be extended by elevating the position of the upper end of the guard 13. Thus, the heater may be further improved with regard to safety performance. The height of the guard 13 can be readily adjusted by changing the width of the guard 13, the length of the leg portions 18 of the fixtures 15, or the relative fixing positions of the guard 13 and the fixing portions 16. The guard 13 and the fixing portions 16 may be fixed by screwing instead of welding. Further, the fitting portions 19 and the roof plate 8*a* may be fixed not by screwing but by engaging the fitting portions 19 with, e.g., retaining holes bored through the roof plate 8*a*. Since the upper and lower end portions 14*a* and 14*b* of the guard 13 are curled, a user may touch the guard 13 without injuring his hand. Moreover, the guard 13 is isolated from the top plate 8 by the fixtures 15, so that the heat of the tray 9 cannot readily be transmitted to the guard 13. Thus, the guard 13 is protected against high temperatures.

Figure 5:
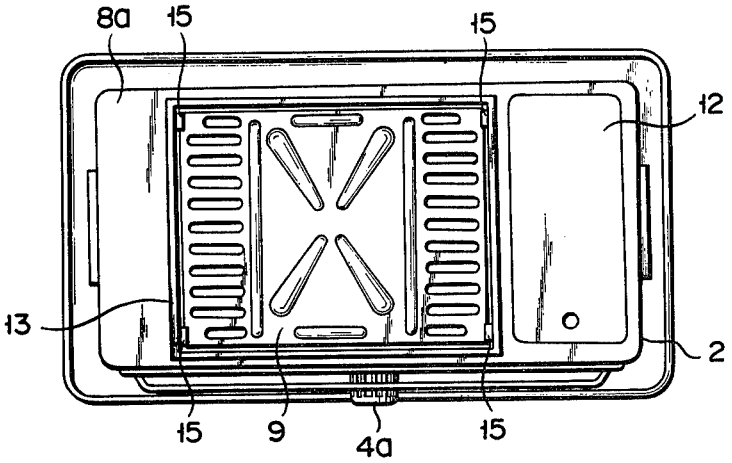
FIGS. 5 to 8 are plan views of heaters showing various modifications of an upper tray.
Figure 6:
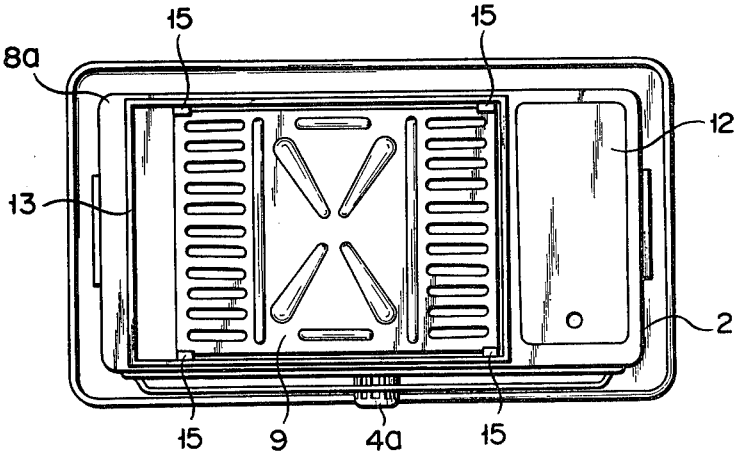
Figure 7:
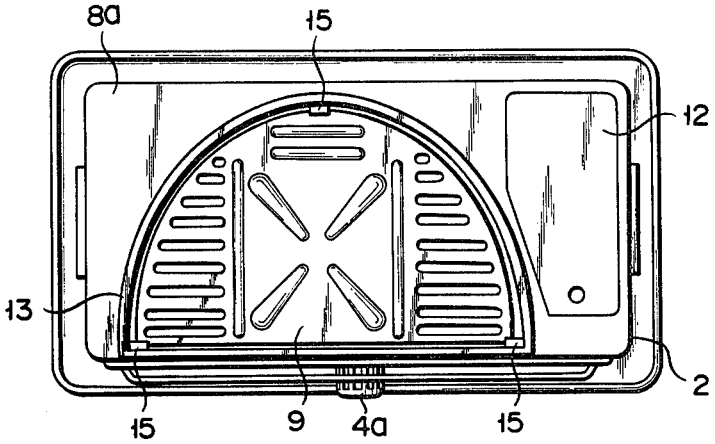
Figure 8:
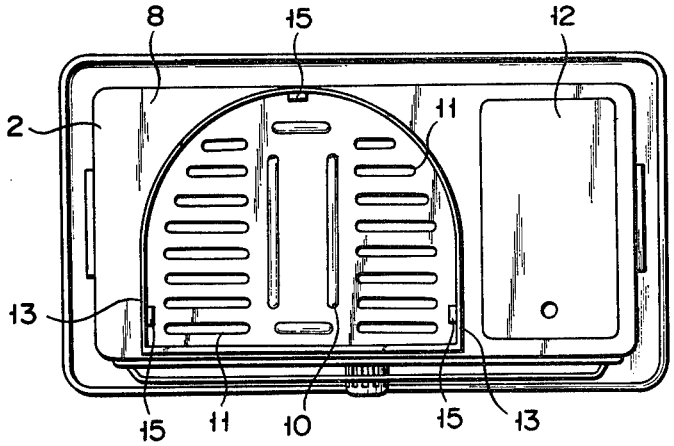

There will now be described modified arrangements of the tray 9 and the guard 13. FIGS. 5 to 8 are plan views of heaters. In FIG. 5, the tray 9 is substantially rectangular. The guard 13 is in the form of a rectangular loop just inside and along the edge of the tray 9. In FIG. 6, the guard 13 extends along the front, right-hand, and rear edge portions of the tray 9 and on the left end portion of the roof plate 8*a*. FIG. 7 shows a heater with a semicircular tray 9. The guard 13 is in the form of a semicircular loop just inside and along the edge of the tray 9. FIG. 8 shows a heater in which the top plate 8 of the housing 2 is an integral body. Also in this case, the guard 13 surrounds the waste gas passage holes 11 over the burner chimney.

Figure 9:
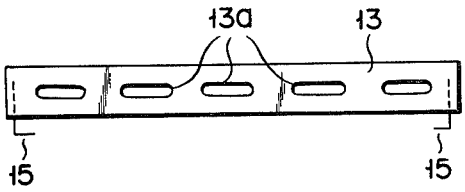
FIG. 9 is a front view showing a modification of the guard.
Figure 10:
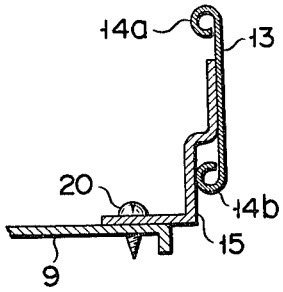
FIG. 10 is a side sectional view showing a modified arrangement of a fixture.
Figure 11:
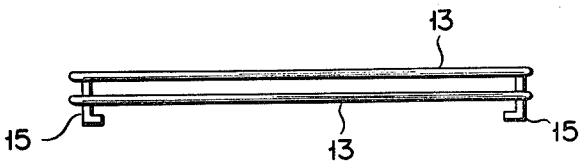
FIG. 11 is a front view showing another modification of the guard.
Figure 12:
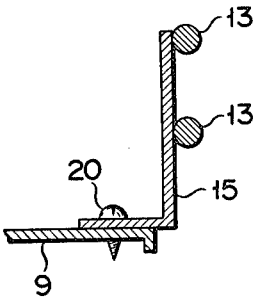
FIGS. 12 and 13 are side sectional views showing modifications of the fixture.
Figure 13:
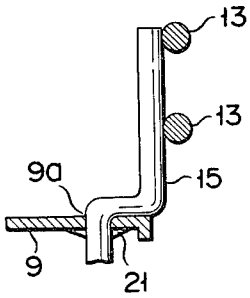
Figure 14:
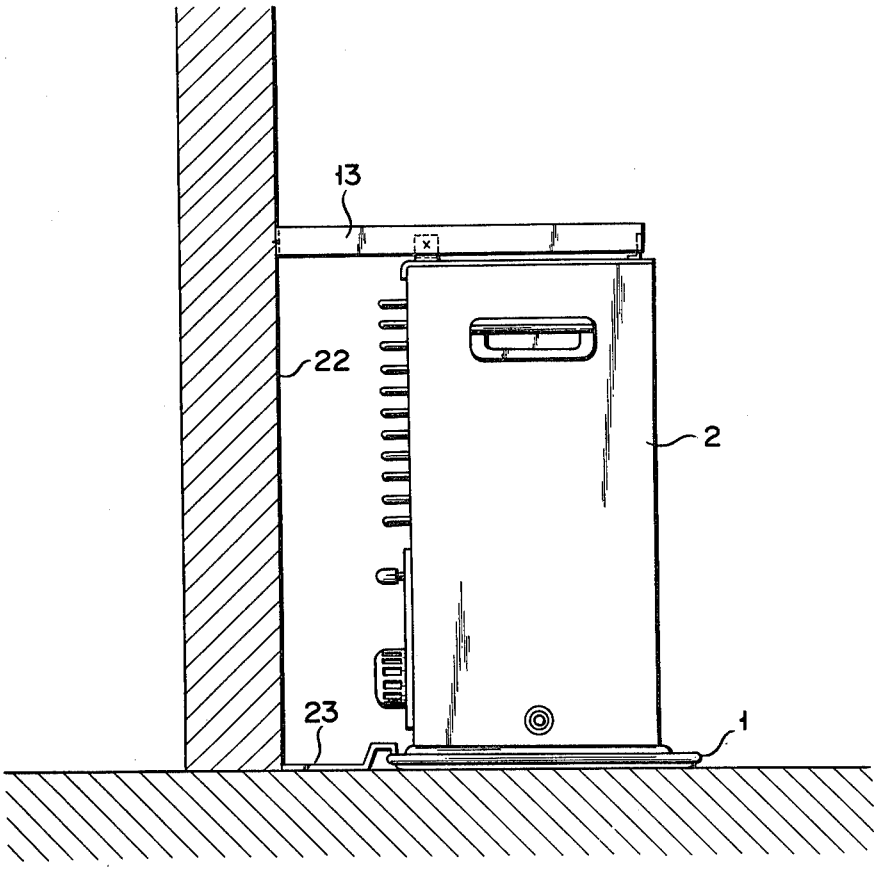
FIG. 14 is a side view of a heater having a spacer.

FIGS. 9 to 13 show modifications of the guard 13 and the fixtures 15. FIG. 9 shows a guard 13 which has a belt-shaped surface and perforations 13*a* bored therein at intervals. Although the fixture 15 in FIG. 4 is screwed to the roof plate 8*a*, a fixture 15 shown in FIG. 10 is screwed to the tray 9. FIG. 11 shows a wire guard 13 formed of two horizontally extending endless wires arranged vertically. FIG. 12 shows modifications in which the wire guard 13 is attached to an L-shaped plate fixture 15. A fixture 15 shown in FIG. 13 is in the form of a Z-shaped wire. In this case, the tray 9 is provided with a hole 9*a* to receive the fixture 15. The fixture 15 is fixed to the tray 9 by inserting the lower end portion of the fixture 15 into the hole 9*a* and fitting a retainer 21 on that portion of the fixture 15 which projects under the tray 9. FIG. 14 shows a heater which has a spacer 23 in front of the base 1. If the heater is set opposite to a wall 22, a space may be kept between the front face of the heater and the wall 22 by the spacer 23. Thus, the wall 22 is not overheated by radiant heat from the burner chimney of the heater. The guard 13 may perform the function of the spacer 23. More precisely, the guard 13 may protrude from the front of the housing 2 until it touches the wall 22, and so a proper space between the wall 22 and the heater may be provided by the guard 13 instead of the spacer 23. The spacer 23 is rockably attached to the base 1. The guard 13 may be detachably connected to the top plate 8 of the housing 2. The heater can thus be made compact merely by detaching the guard 13 from the top plate 8 and moving the spacer 23 upward.

As described above, the guard 13 protrudes from the top plate 8 and surrounds that portion of the top plate 8 which is heated to a high temperature. Should flammable objects, such as clothes, fall on the heater, the guard 13 prevents them from touching the high-temperature portion of the top plate 8. This helps to reduce the chance of fire. Since it is curved along the circumference of the high temperature portion of the top plate 8, the guard 13 does not hinder the user in putting a kettle or a pot on the tray 9. Nor does it hinder the opening or closing of the cover 12.

The present invention is not limited to such kerosene space heaters as described above. It may be applied to a reflection type heater such as a gas space heater or an electric space heater.

What we claim is:

1. A reflection type heater comprising:

combustion equipment for burning fuel;

a box-shaped housing having a front face with a front opening and a top face, and containing the combustion equipment therein;

a reflecting member provided behind the combustion equipment for reflecting radiant heat from the combustion equipment toward the front opening;

a cartridge tank provided behind the reflecting member for storing fuel and supplying it to the combustion equipment;

a top plate laid on the top face of the housing, and having a first region in front of the reflecting member and a second region behind the reflecting member, the top plate including an inlet opening provided to the second region for inserting the cartridge tank into the housing and a cover for opening and closing the inlet opening; and a guard protruding upward from the surface of the top plate and extending so as to substantially only surround the first region of the top plate.

2. A reflection type heater according to claim 1, wherein said reflecting member includes a reflecting plate extending between both side edges of the front opening so as to envelop the back of the combustion equipment, and said first region is defined by the reflecting plate.

3. A reflection type heater according to claim 2, wherein said top plate includes a tray located in the first region, and a roof plate located in the second region.

4. A reflection type heater according to claim 3, wherein said guard extends along the edge of the tray.

5. A reflection type heater according to claim 4, wherein said tray is substantially triangular.

6. A reflection type heater according to claim 4, wherein said tray is substantially rectangular.

7. A reflection type heater according to claim 4, wherein said tray is substantially semicircular.

8. A reflection type heater according to claim 4, wherein said guard is in the form of an endless belt with its surface vertical.

9. A reflection type heater according to claim 8, wherein the upper and lower end portions of said guard are curled toward the region surrounded by the guard.

10. A reflection type heater according to claim 4, wherein said guard is in the form of an endless wire with its longitudinal direction horizontal.

11. A reflecting type heater according to claim 4, comprising substantially L-shaped plate-like fixtures provided to the top plate, the guard being attached to the fixtures.

12. A reflection type heater according to claim 4, comprising wire fixtures bent so as to be substantially Z-shaped, wherein said top plate has a plurality of holes, the guard being attached to the wire fixtures, the lower ends of said wire fixtures being inserted in the holes of the top plate.

13. A reflection type heater according to claim 3, wherein said tray is integral with the roof plate to constitute the top plate.

14. A reflection type heater according to claim 3, wherein a part of said guard extends along the edge of the tray, and the remaining part lies on the roof plate.

15. A reflection type heater according to claim 3, wherein a part of said guard projects in front of the housing.

* * * * *